United States Patent [19]

Brännstam

[11] Patent Number: 4,635,931

[45] Date of Patent: Jan. 13, 1987

[54] APPARATUS FOR ARM AND LEG EXERCISE

[76] Inventor: Gunilla Brännstam, Blomstervägen 17, S-54141 Skövde, Sweden

[21] Appl. No.: 647,850

[22] Filed: Sep. 6, 1984

[30] Foreign Application Priority Data

Sep. 13, 1983 [SE] Sweden ..... 8304902
Feb. 23, 1984 [SE] Sweden ..... 8400994

[51] Int. Cl.[4] ..... A63B 21/00; A63B 23/04; A61H 1/02

[52] U.S. Cl. ..... 272/130; 272/96; 128/25 B

[58] Field of Search ..... 272/130, 135–139, 272/141, 142, 900, 96; 128/25 B

[56] References Cited

U.S. PATENT DOCUMENTS 3,524,643 8/1970 Hazelitt ..... 272/900
3,884,463 5/1975 Malatesta ..... 272/130
4,111,416 9/1978 Jinotti ..... 272/900

FOREIGN PATENT DOCUMENTS 0156376 1/1903 Fed. Rep. of Germany .
2145884 4/1980 Fed. Rep. of Germany ..... 272/900
2031742 4/1980 United Kingdom ..... 272/130

*Primary Examiner*—Robert A. Hafer
*Assistant Examiner*—Kathleen J. D'Arrigo
*Attorney, Agent, or Firm*—Witherspoon & Hargest

[57] ABSTRACT

The device of the invention for exercising the leg and arm musculature of a person lying in a bed consists of a bellows (2) which with one of its ends is adapted to be attached to for instance a bedstead end in a manner by which it is tiltable about a horizontal axis and lockable in a desired position of tilt and which at the other end thereof carries a foot or hand attachment member (3) to which the foot or hand may be attached to permit the person lying in the bed to both compress and extend the bellows. The resistance of the bellows to the said movements are controllable as desired by means of a valving device (11).

12 Claims, 3 Drawing Figures

APPARATUS FOR ARM AND LEG EXERCISE

It has long been well known that persons which for some reason have been bedridden for a long period of time run the risk of contracting special diseases caused by the confinement to the bed and the relative immobility this means. Examples of such diseases are thrombosis, muscular atrophy and skeletal decalcification.

Devices of various types have been suggested for exercising the muscles of a person lying in a bed for eliminating the risk of diseases of the above kind being developed. Examples of such known devices are the so called bed-bicycle and devices to which a person's foot or hand can be attached and which are to offer a suitable resistance to movements to exercise the muscles. The known devices are unwieldly or costly and/or would not afford the intended exercise of the muscles in a satisfactory manner. For instance, in some of the known devices springs are used as resistance-exerting members. However, these are not easily adjustable to provide varied resistance. Providing resistance to movements in both directions, which is often desirable, is especially difficult with such apparatuses working on the basis of springs. Also the bed-bicycle offers resistance in one direction only. Nor do the known devices make possible the special exercise of the muscles of the calf which is especially important to avoid thrombosis.

The present invention hence for its object has the provision of a device for exercising the leg or arm musculature of a person lying in a bed, including the musculature of the calf. A further object of the invention is the provision of such an apparatus, which is simple and hence of low cost. A still further object of the invention is such an apparatus which is reliable and adjustable such that, on one hand, it can offer a desired resistance to limb bending and straightening movements in either direction and differing resistances to such movements in both directions. All the above objects are obtained by the device of the claims.

Figure 1:
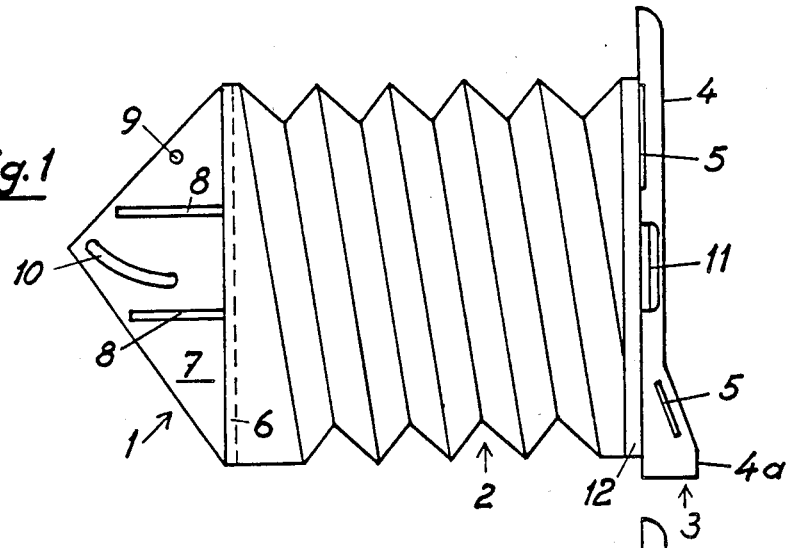
Figure 2:
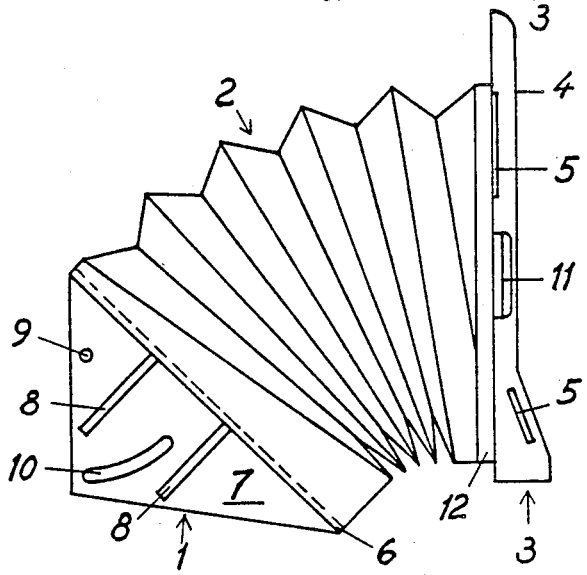
Figure 3:
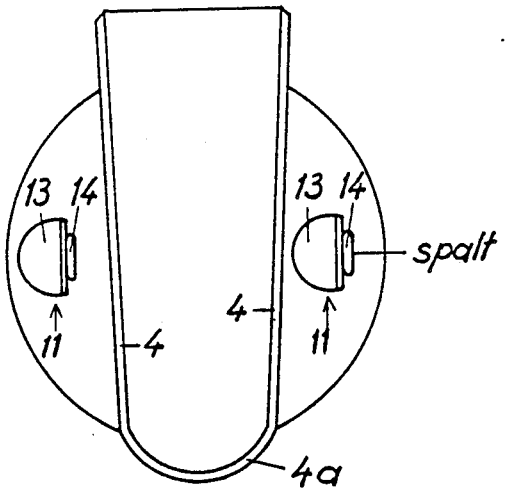

An embodiment of the invention which in the first place is intended for exercising the leg musculature is explained in detail below with reference to the attached drawing, wherein FIG. 1 is an elevational view of the device, FIG. 2 is a view of the device similar to the one of FIG. 1 but showing the plate of attachment of the device attached at an angle to the foot attachment member for exercising especially the musculature of the calf, and FIG. 3 is a view looking toward the end of the device facing the patient's foot.

The embodiment of the device according to the invention shown in the Figures of the drawing consists of three main parts, namely an attachment 1 for attaching the device in a suitable manner to allow a person lying in a bed to use the device in the intended manner, for instance to the foot-end of a bedstead, a bellows 2 attached at one of its ends to attachment 1 and constituting the element offering resistance to the person's leg movements, and a foot plate 3 attached to the other end of the bellows and on which a person can attach his or her foot in such a manner that, on one hand, the foot will firmly rest on the foot plate when a straightening movement is carried out with the leg so that the foot will exert a pressure on the foot plate, and, on the other hand, that the foot will pull the foot plate when a bending movement is carried out so that the foot can exert a pulling force on the foot plate.

Foot plate 3 preferably is of an oblong shape roughly corresponding to that of a foot. It may be made of wood or any other suitable material. Preferably, it is provided with longitudinal edge ledges 4 protruding somewhat above the foot supporting surface of the foot plate to give the foot lateral support and joined by a ledge portion 4a intended to especially support the heal and therefor shaped as shown in FIG. 1 to protrude the most at the point which in the intended position of use of the device constitutes the lowest point of the foot plate, from which point ledge portion 4a with diminishing amount of protrusion extends toward and merges in ledge portions 4. Of course, foot plate 3 may be shaped to more exactly conform to the sole of the foot (or rather the whole bottom of the foot) and it may also be provided with a soft material to prevent galls from being caused.

When bending movements are made with the leg, to allow the foot to pull foot plate 3 together with bellows 2, foot plate 3 is provided with straps or tapes (not shown), preferably Velcro tapes, for attaching the foot to the plate. FIGS. 1 and 2 show apertures or slots 5 in the foot plate for the attachment of the straps or tapes. In case the arm muscles are to be exercised member 3 is provided with a suitable knob or grip (not shown).

Bellows 2 is of a conventional type and therefor need not be described in detail. It may be of circular or polygonal cross-section and preferably is made from a wear-proof synthetic or natural material.

Attachment 1 has a plate 6 the distal and end face of which is indicated by a broken line in FIGS. 1 and 2 and on which bellows 2 is attached with its end in a manner immediately understood by the expert. A substantially triangular portion 7, preferably in the form of a rather thin disc of for instance plate steel or the like, is attached to the side of plate 6 facing away from bellows 2 and along a diameter of the plate and substantially at right angles thereto. If required triangular portion 7 may be provided with stiffening ribs 8. Portion 7 is intended to be pivotably attached to the bedstead foot-end, for instance by means of a screw or shaft (not shown) inserted through a hole 9 in portion 7. Also, portion 7 is provided with an arcuate slot 10, of such location, length and orientation with respect to hole 9 (the location of which in its turn is determined by the desired mounting on the bedstead end) that portion 7, from the position shown in FIG. 1, may be rotated to a position with respect to bellows 2 and foot plate 3 which corresponds to the position shown in FIG. 2, with a locking device (not shown) extending through slot 10, such as a bolt cooperating with a winged nut, and locked thereby in the desired orientation, or angular position. When this orientation corresponds to the one shown in FIG. 2 the device permits exercising the calf musculature in that, as is immediately seen, the oblique position of plate 6 of attachment 1 in the manner shown in FIG. 2 with respect to bellows 2 and foot plate 3 permits the foot to be twisted backwards and forwards about the angle-joint. This requires the cooperation of the calf muscles. The activity of the calf muscles pumps the blood in the veins of the leg, and therefor a person lying in a bed may reduce the risk of thrombosis by regularly activating the calf musculature.

In order to enable the foot attached to foot plate 3 to be moved forwardly and backwardly toward and from attachment 1 while air is respectively forced out of and sucked into bellows 2 the latter evidently must be provided with some form of valving device. In the embodiment shown the valving device is constituted by two valves 11 placed on either side of foot plate 3, namely on a plate 12 which terminates bellows 2 at the foot end thereof. Each valve consists of a lid 13 rotatable in such a manner that by the amount desired they may be made to cover through slots 14 in plate 12. The resistance of the bellows to its inspiring and exhausting air is thereby controlled as desired. Also, one of the valves preferably is a non-return valve (not shown). The non-return valve is adapted to permit only inspiration of air, not exhaustion of air. The bellows then will offer a greater resistance when compressed than when extended, i.e. the straightening movement will require a greater force than the bending movement which is desirable since the straightening muscles should be subjected to more intense exercise than the bending muscles. Of course, additional valves may be provided to increase the capability of controlling the resistance of bellows 2 to the bending and straightening movements and the mutual relationship between the forces required by these two kinds of movements.

The invention so far has been described with respect to the use thereof by a person lying in a bed. The expression "lying in a bed" used above, however, shall not here be considered to mean solely "bedridden" or "confined to bed". Thus, the device may advantageously be used for instance in the area of domestic medical attendance and in training premises where the device can be used by persons temporarily lying on beds or the like. At home the device cannot usually be attached to a bedstead end since ordinary beds usually are not stable enough. In stead, the device in such cases can be attached to a wall. In a training hall the device may advantageously be attached to wall bars.

In physiological laboratories the device according to the invention may be used for carrying out for instance work tests by interconnecting two bellows by an air hose provided with a pressure or flow gauge. Carrying out such tests using a training bicycle, as is often made at present, is very troublesome on account of all the hoses and lines which are connected to the persons which are to carry out such tests.

I claim:

1. A device for use by a person lying on a bed to exercise a limb comprising an attachment (1) for attaching the device to or adjacent the bed in a manner suitable for the intended use of the device, a member (3) for engagement with the limb of the person lying on the bed, a bellows (2) having one end coupled to the attachment and another end coupled to the member for exerting a pressure on the member as the bellows is compressed when the limb is straightened and for exerting a pulling force on the member as the bellows is extended when the limb is subjected to a bending movement, the attachment being moveably mounted relative to a horizontal axis for movement of the attachment and the one end of the bellows coupled thereto to a fixed angular position relative to the position of the member when the bellows is extended so that the limb can be twisted backwards and forwards relative to the horizontal axis in response to limb bending and straightening movements as the bellows is extended and compressed, respectfully.

2. The device of claim 1, characterized in that the inspiration of air into and the exhaustion of air out of the bellows (2) is controlled by at least two valves (11), each one of which is adjustable for permitting choice of desired resistance to the flow of air therethrough.

3. The device of claim 2, characterized in that at least one of the valves (11) is a non-return valve preferably adapted to permit only inspiration of air into the bellows (2).

4. The device of claim 1, characterized in that the attachment (1) is constituted by a plate (6) for attaching the end of the bellows (2) remote from the member (3), said plate carrying a portion (7) which is at substantially right angles to the plate, preferably is of triangular shape and preferably is stiffened by at least one rib (8), the portion being adapted to be attachable to a fixed bedstead end or a fixed member adjacent the bed and to be rotatable in a vertical plane and lockable in the desired position of rotation.

5. The device of claim 4 characterized in that the member (3) is constituted by a plate (12) attached to the free end wall of the bellows (2), the member (3) at least to some extent being conformed in configuration for attachment to the body so that both a pushing as well as pulling force may be exerted on the plate, and hence, on the bellows (2).

6. The device of claim 5 characterized in that the member (3) is conformed for attachment to the foot and comprises a ledge (4, 5) adapted to offer transverse support to the foot.

7. A device for exercising the limb musculature of a person lying in a bed, characterized by a bellows (2) provided between an attachment (1) for attaching the device to or adjacent the bed in a manner suitable for the intended use of the device by a person lying on the bed, and a member (3) intended for attachment to the limb of the person lying on the bed, the exertion of pressure on the member as the bellows is compressed when the limb is straightened, and the exertion of a pulling force on the member as the bellows is extended when the limb is subjected to a bending movement, respectively, being valve-controlled, the inspiration of air into and the exhaustion of air out of the bellows (2) being controlled by at least two valves (11), each one of which is adjustable for permitting choice of desired resistance to the flow of air therethrough, the member (3) comprising a plate (12) attached to a free end wall of the bellows (2), the member (3) at least to some extent being conformed in configuration for engagement by the limb so that both a pushing as well as pulling force may be exerted on the plate and, hence, on the bellows (2).

8. The device of claim 7 characterized in that the member (3) is conformed for attachment to the foot and comprises a ledge (4, 5) adapted to offer transverse support to the foot.

9. A device for exercising the limb musculature of a person lying in a bed, characterized by a bellows (2) provided between an attachment (1) for attaching the device to or adjacent the bed in a manner suitable for the intended use of the device by a person lying on the bed, and a member (3) intended for attachment to the limb of the person lying on the bed, the exertion of pressure on the member as the bellows is compressed when the limb is straightened, and the exertion of a pulling force on the member as the bellows is extended when the limb is subjected to a bending movement, respectively, being valve-controlled, the inspiration of air into and the exhaustion of air out the bellows (2) being controlled by at least two valves (11), each one of which is adjustable for permitting choice of desired resistance to the flow of air therethrough, at least one of the valves (11) being a non-return valve preferably adapted to permit only inspiration of air into the bellows (2), the member (3) comprising a plate (12) attached to a free end wall of the bellows (2), the member (3) at least to some extent being conformed in configuration for engagement by the limb so that both a pushing as well as pulling force may be exerted on the plate and, hence, on the bellows (2).

10. The device of claim 9 characterized in that the member (3) is conformed for attachment to the foot and comprises a ledge (4, 5) adapted to offer transverse support to the foot.

11. A device for exercising the limb musculature of a person lying in a bed, characterized by a bellows (2) provided between an attachment (1) for attaching the device to or adjacent the bed in a manner suitable for the intended use of the device by a person lying on the bed, and a member (3) intended for attachment to the limb of the person lying on the bed, the exertion of pressure on the member as the bellows is compressed when the limb is straightened, and the exertion of a pulling force on the member as the bellows is extended when the limb is subjected to a bending movement, respectively, being valve-controlled, the inspiration of air into and the exhaustion of air out of the bellows (2) is controlled by at least two valves (11), each one of which is adjustable for permitting choice of desired resistance to the flow of air therethrough, at least one of the valves (11) being a non-return valve preferably adapted to permit only inspiration of air into the bellows (2), the attachment (1) being adapted to permit tilting the end wall of the bellows (2) with which the bellows is connected to the attachment with respect to the position of use of the bellows end wall which is connected to the member (3) so as to allow tilting the first-mentioned end wall of the bellows by a substantial angle with respect to the attachment, the member (3) comprising a plate (12) attached to a free end wall of the bellows (2), the member (3) at least to some extent being conformed in configuration for engagement by the limb so that both a pushing as well as pulling force may be exerted on the plate and, hence, on the bellows (2).

12. The device of claim 11 characterized in that the member (3) is conformed for attachment to the foot and comprises a ledge (4, 5) adapted to offer transverse support to the foot.

* * * * *